US007486304B2

(12) United States Patent
Bergquist et al.

(10) Patent No.: US 7,486,304 B2
(45) Date of Patent: Feb. 3, 2009

(54) DISPLAY DEVICE WITH DYNAMIC COLOR GAMUT

(75) Inventors: Johan Bergquist, Tokyo (JP); Carl Wennstam, Tokyo (JP)

(73) Assignee: Nokia Corporation, Espoo (FI)

( * ) Notice: Subject to any disclaimer, the term of this patent is extended or adjusted under 35 U.S.C. 154(b) by 581 days.

(21) Appl. No.: 11/316,321

(22) Filed: Dec. 21, 2005

(65) Prior Publication Data

US 2007/0139449 A1 Jun. 21, 2007

(51) Int. Cl.
*G09G 5/10* (2006.01)

(52) U.S. Cl. ..... 345/690; 345/88; 345/691

(58) Field of Classification Search ..... 345/690, 345/691, 87–89, 589, 590, 593
See application file for complete search history.

(56) References Cited

U.S. PATENT DOCUMENTS

| | | | | |
|---|---|---|---|---|
| 6,392,656 | B1 * | 5/2002 | Someya et al. | 345/690 |
| 6,556,181 | B2 * | 4/2003 | Yamada et al. | 345/88 |
| 2004/0036820 | A1 | 2/2004 | Runolinna | |

FOREIGN PATENT DOCUMENTS

| | | |
|---|---|---|
| GB | 2403096 A | 12/2004 |
| JP | 2001-123661 | 5/2001 |
| JP | 2002-244626 | 8/2002 |
| JP | 2002-318564 | 10/2002 |
| JP | 2004-045466 | 12/2004 |

OTHER PUBLICATIONS

Power Minimization of LED Backlight in a Color Sequential Display, Wayne Cheng, Dept. of Photonics, National Chiao Tung University, Hsinchu, Taiwan, 40.3, SID 05 Digest, p. 1384-1387 , 2005.
RGB Color Control System for LED Backlights in IPS-LCD TVs, A. Konno, Y. Yamamoto, and T. Inuzuka, Materials Research Lab, Hitachi, Ltd., SID 05 Digest, 40.2, p. 1380-1383, undated.
Requirements for LCD to Gain High Moving Image Quality, Taiichiro Kurita, AM-LCD 2000, Science and Technical Research Laboratories, NHK, p. 1-4, 2000.
Implementation of RGBW Color System in TFT-LCDs, Baek-woon Lee, et al, Samsung Advanced Institute of Technology, SID 04 Digest, 9.2, p. 111-113, undated.
Field-Sequential Colour Display with Adaptive Gamut, Johan Bergquist and Carl Wennstam, Multimedia Technologies Laboratory, undated.

* cited by examiner

*Primary Examiner*—Regina Liang
(74) *Attorney, Agent, or Firm*—Ware, Fressola, VanDer Sluys & Adolphson LLP

(57) ABSTRACT

The specification and drawings present a new method, apparatus and software product for dynamically adjusting a color gamut of a display (e.g., a field sequential color display) and further adjusting a luminance of the display in an electronic device by adjusting and turning on field duties of primary colors. During each color field, the other primary colors of light sources supporting the display can be turned on at their respective fractions of their color field. These fractions can be continuously tunable in order to control the color coordinate of each primary color dynamically thus adjusting the color gamut and the luminance of the display.

24 Claims, 4 Drawing Sheets

DISPLAY DEVICE WITH DYNAMIC COLOR GAMUT

TECHNICAL FIELD

The present invention relates generally to electronic devices with displays and, more specifically, to dynamically adjusting a color gamut of a display and further adjusting a luminance of the display in an electronic device.

BACKGROUND

A widespread consumption of information-intensive multimedia requires high-resolution, high-contrast, wide-color displays with a blur-free video. Traditional transflective LCDs (liquid crystal displays) provide legibility in a wide range of illuminances but are difficult and expensive to implement at high resolutions. Emissive displays such as organic light-emitting diode displays (OLEDs) and transmissive LCDs provide a good color and high resolution, respectively, but suffer from low contrast at high illuminances. Outdoor contrast can be improved by increasing display luminance but at the expense of the higher power consumption and/or permanently reduced color saturation. For display contents such as text-viewing and web-browsing, however, color saturation requirements are relaxed, and hence the outdoor luminance contrast can be increased by deliberately sacrificing the color reproduction (the reflective mode of transflective displays also has low color saturation). When indoors, such an approach will instead result in lower power consumption because a sufficent luminance contrast is possible to achieve with lower backlight power.

For other applications, the color reproduction may be more important such that the power consumption can be sacrificed for higher color saturation. Blur-free video can only be achieved with an intermittent backlight, which, however, inevitably reduces the average luminance and hence contrast in the outdoors. Also in this case, the luminance can be gained by deliberately reducing the color gamut.

Conventional LCDs and OLEDs are spatially divided into picture elements (pixels) which, in turn, are spatially divided into individually addressable subpixels which represent each primary color, e.g., RGB (red, green, blue). In the case of LCDs, white light from the surroundings (reflective displays) or from the backlight (transmissive displays) is filtered through primary colour filters on the subpixels to form pixels of any color. Field sequential color displays (FSCDs) are transmissive displays without subpixels or color filters and the image is instead formed by a sequence of images separated into each primary color, e.g. RGB. This sequence is faster than the integration time of the human visual system (HVS) so the colors are "fused" in the brain.

Transmissive LCDs are desirable for high-resolution displays above 300 pixels-per-inch, e.g., 2.4" 480×640 displays. However, pixel aperture ratio decreases by increased resolution, resulting in increased optical losses. Moreover, dense color filters are required for saturated colors but their large absorption together with small aperture ratio results in low luminance and hence low contrast in the outdoors. The FSCDs has a larger aperture ratio because the pixel area is not divided into three primary color areas. Neither does it use absorbing color filters but each color is, on the other hand, only displayed during maximum 1/Nth of the time where N is the number of primary colors. In addition, primary color LEDs, e.g. RGB, have a lower luminous efficiency compared to white LEDs used in color filter-based displays.

Compared to conventional transmissive LCDs, the FSCDs feature blur-free video thanks to the intermittent nature of the backlight. Also, their resolution is N times higher than a color filter display and the number of primaries is scalable, even after the display has been fabricated. However, the LEDs of FSCDs have lower luminous efficiency so higher power consumption is required to achieve adequate outdoor contrast.

High moving image quality is generally achieved by reducing the frame duty, e.g., reducing the fraction of the frame or field during which an image is displayed, but at the expense of the average luminance. The sequential displaying of each primary in FSCDs also inevitably leads to color break-up, e.g., brief colored flashes when the terminal is shaken or when the gaze point is changed across the display. Color breakup also manifests itself as colored edges of moving objects when tracked by the eyes.

White point adjustment of a display is usually done by bending the gamma curves but this results in a bit depth loss via gray shade compression, i.e., only a part of the addressable colors are distinguishable.

Primary-color LEDs used in FSCDs exhibit a larger manufacturing spread in luminance and wavelength than white LEDs and hence a larger spread in display white point. Finally, FSCDs or any display with intermittent backlight is a subject to a flicker at sufficiently low frame rates and/or high luminances.

The luminance problem of FSCDs has been attempted to be resolved by adding more LEDs, overdriving the existing ones or selecting LEDs with less color saturation. However, this typically results in higher cost, shorter LED life time, higher power consumption, as well as permanently lower color saturation, respectively.

For example, one way to increase luminous efficiency of LCDs is to employ an extra white primary "color". This has been proposed both in the spatial domain (RGWB subpixels) by B.-W. Lee, K. Song, Y. Yang, C. Park, J. Oh, C. Chai, J. Choi, N. Roh, M. Hong, K. Chung, S. Lee, C. Kim, "Implementation of RGBW Color System in TFT-LCD", Paper 9.2, p 111, SID Digest (2004), and in the temporal domain (RGBW color fields) by Y. Toshiakaki, B. Keiichi, M. Tesuya and T. Shinji, Japanese patent application JP-2002-318564. While this provides 50% higher luminance for full white, it also results in 25% lower luminance of fully saturated pixels, assuming the same backlight. Another approach (e.g., see Pentile Matrix technology by Clairvoyante Laboratories, www.clairvoyante.com) is to spatially sub-sample blue utilizing the lower retinal resolution in the blue and lower contribution to the luminance. All these approaches suffer from a fixed spatial/temporal pattern and is therefore less flexible when trading off luminance for gamut.

DISCLOSURE OF THE INVENTION

According to a first aspect of the invention, a method for dynamically adjusting a display in an electronic device, comprises the steps of: determining field duties of N primary colors in K color fields using a predefined procedure, wherein $N \geqq 3$ and $K \geqq N$; and determining for each color field of the K color fields further field duties of colors of the N−1 primary colors not included in the each color field using a predetermined criterion to dynamically control each of the N primary colors, such that the colors with the further field duties can be used in the color fields for dynamically adjusting a color gamut of the display.

According further to the first aspect of the invention, the method may further comprise the step of: turning on the colors with the further field duties in the each color field.

Further according to the first aspect of the invention, the display may be a field sequential color display.

Still further according to the first aspect of the invention, the display may be at least one of: a liquid crystal display (LCD), a micro-electro-mechanical systems (MEMS) display, a direct-view display, a near-eye display or a projection display.

According further to the first aspect of the invention, the primary colors may be red, green and blue.

According further to the first aspect of the invention, before the step of determining the field duties of the N primary colors, the method may comprise the step of: determining color coordinates of the primary colors of light sources such that these color coordinates can be used for the determining of the further field duties.

According further still to the first aspect of the invention, if a moving image quality is given a priority, the field duties of the N primary colors may be assigned a predetermined value.

According yet further still to the first aspect of the invention, the field duties of the N primary colors may be determined using a desired white point.

Yet still further according to the first aspect of the invention, the further field duties may be fractions of the field duties in the each color field.

Still further still according to the first aspect of the invention, the method may further comprise the steps of: determining a coefficient between zero and one using a further predetermined criterion; and multiplying the field duties and the further field duties by the coefficient for dynamically adjusting a luminance of the display.

According still further to the first aspect of the invention, the colors with the further field duties may be used in the color fields for dynamically adjusting a luminance of the display.

According to a second aspect of the invention, a computer program product comprises: a computer readable storage structure embodying computer program code thereon for execution by a computer processor with the computer program code characterized in that it includes instructions for performing the steps of the first aspect of the invention indicated as being performed by any component or a combination of components of the electronic device. Further, the computer readable storage structure may comprise the steps of: determining a coefficient between zero and one using a further predetermined criterion; and multiplying the field duties and the further field duties by the coefficient for dynamically adjusting a luminance of the display.

According to a third aspect of the invention, an electronic device with a display, comprises: a field selector, for defining K color fields for N primary colors, wherein $N \geqq 3$ and $K \geqq N$; and a PWM controller, for determining field duties of the N primary colors in the K color fields using a predefined procedure, for further determining for each color field of the K color fields further field duties of colors of the N primary colors not included in the each color field using a predetermined criterion to dynamically control each of the N primary colors, such that the colors with the further field duties can be used in the color fields for dynamically adjusting a color gamut of the display.

According further to the third aspect of the invention, the electronic device may further comprise: means for turning on the colors with the further field duties in the each color field.

Further according to the third aspect of the invention, the display may be a field sequential color display.

Still further according to the third aspect of the invention, the display may be at least one of: a liquid crystal display (LCD), a micro-electro-mechanical systems (MEMS) display, a direct-view display, a near-eye display or a projection display.

According further to the third aspect of the invention, if a moving image quality is given a priority, the field duties of the N primary colors may be assigned a predetermined value.

According still further to the third aspect of the invention, the field duties of the N primary colors may be determined using a desired white point balance.

According yet further still to the third aspect of the invention, the further field duties may be fractions of the field duties in the each color field.

According further still to the third aspect of the invention, the electronic device may further comprise: means for determining a coefficient between zero and one using a further predetermined criterion and multiplying the field duties and the further field duties by the coefficient for dynamically adjusting a luminance of the display.

Yet still further according to the third aspect of the invention, the means for determining the coefficient between zero and one may be a part of the PWM controller.

Still yet further according to the third aspect of the invention, the electronic device may be a non-portable electronic device, a television, a computer, a monitor, a wireless communication device, a mobile phone, a camera-phone mobile device or a portable electronic device.

Still further still according to the third aspect of the invention, the colors with the further field duties may be used in the color fields for dynamically adjusting a luminance of the display.

It is noted that, a luminance increase by dynamic desaturation of the primaries, accomplished according to embodiments of the present invention, saves power and cost because it can be done with existing number of LEDs and with increasing the luminous efficiency. Therefore, fewer light sources (e.g., LEDs) are needed and/or smaller duties are sufficient. The light sources (e.g., LEDs) can also be driven at lower average currents, resulting in longer life times. The light sources (e.g., LEDs) with larger manufacturing spread in luminous intensity and peak wavelengths can be used and hence save backlight costs as well. Moreover, a higher color saturation is possible at lower illuminances. Blur-free video, and reduction of the color breakup can be achieved without increasing the frame rate, hence saving driving power. White point adjustment can be done over the entire gamut without loss in bit depth and while maintaining the luminous efficiency.

Furthermore, by operating the light sources (e.g., LEDs) at a constant and optimum current and by controlling the luminance and the color gamut by the pulse-width modulation (PWM), the maximum luminous efficiency can be achieved for any luminance. With the dynamic RGB (or multi-primary in general) sensor option, white point is ensured even after LED aging or at temperatures other than at room temperature.

With the dynamic gamut recited in embodiments of the present invention, the native color depth (number of addressable colors) will remain unchanged while providing a luminance boost of up to 300% for fully desaturated images. In dark environments where lower luminance is preferable, the continuous luminance-gamut trading can achieve a color saturation much higher than displays based on fixed chromaticities of the backlight primaries and color filters.

It is noted that FIGS. 1-6 demonstrate examples for three primaries (RBG) but can be used with any number of primaries.

MODES FOR CARRYING OUT THE INVENTION

A new method, apparatus and software product is presented for dynamically adjusting a color gamut of a display and further adjusting a luminance of the display in an electronic device by adjusting and turning on field duties of primary colors. The display can be any field sequential color display with any number of primaries and any number of color fields, the latter larger or equal to the former. Also, according to embodiments of the present invention, the display can be, but is not limited to, a liquid crystal display (LCD), a micro-electro-mechanical systems (MEMS) display, etc. Also, the displays utilizing different modes can be used, including (but not be limited to) a direct-view display, a near-eye display, a projector display, etc.

The electronic device can be, but is not limited to, a non-portable electronic device, a television, a computer, a monitor, a wireless communication device, a mobile phone, a camera-phone mobile device, a portable electronic device, etc.

According to embodiments of the present invention, during each color field, the primary colors (also called "primaries") other than the one belonging to each colour field can be turned on at their respective fractions of the color field (or alternatively called "color field period"). These fractions can be continuously tunable in order to control the color coordinate of each primary color dynamically thus adjusting the color gamut and the luminance of the display. Moreover, the number N of primary colors and the number K of color fields can be chosen arbitrary: the latter may be larger or equal, but not smaller, than the former (i.e., $K \geqq N$) and the number of the primary colors can be 3 or larger ($N \geqq 3$). Examples of the implementation alternatives, according to embodiments of the present invention, are described below in detail.

Figure 1:
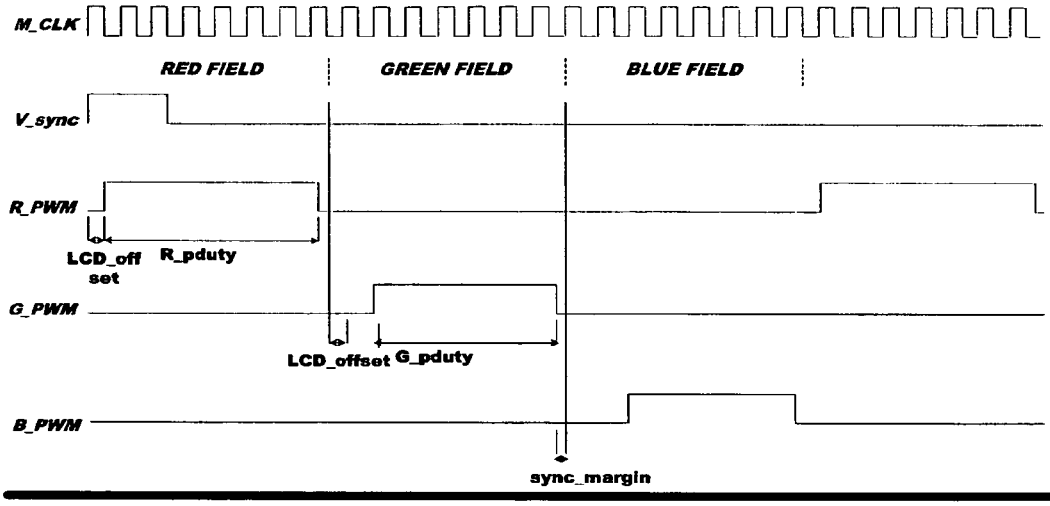
FIG. 1 is a timing diagram depicting synchronization signals and three primary (RGB) signals wherein a desired white point balance is carried out by adjusting the relative durations of R, G, and B periods.

First, chromaticities (or alternatively called "color coordinates") of the primaries (e.g., LED light sources) are determined either statically (e.g., by colorimetry at the production plant) or dynamically (by an RGB sensor in the electronic device) and the values can be stored in a re-writable, non-volatile memory in the electronic device. Next, the white point is set, for instance, from user preferences by calculating the corresponding temporal ratios (alternatively called here "field duties") of the primaries. FIG. 1 is an example of a timing diagram depicting synchronization signals and three primary (RGB) signals wherein a desired white point balance has been carried out by adjusting the relative durations of R, G, and B periods. The example of FIG. 1 shows frame duties of primaries for the desired white point balance (X_pduty, where X is the primary, e.g. RGB). This is done at intervals relevant to the chromaticity stability of the light sources, for example when temperature has changed or when the device has been operated for a certain time.

Furthermore, during operation of the electronic device, chromaticities of the most saturated colors among all pixels in each frame are determined. This can be done both off-line or on-line by calculating and finding the maximum geometrical distances from the white point in an Euclidian and uniform color space. The image content, application are analyzed and the saturation of each primary is determined so that all pixel chromaticities exactly lie within the gamut. This is done by scaling the original display gamut triangle (polygon in the case of multiprimary displays) until the chromaticity of the most saturated pixel appears on its edge.

Then the chromaticities of the light sources of the display of the electronic device are determined in the same color space as the chromaticites of the most saturated colors among all pixels determined by using a sensor that can determine the relative luminance of each primary, e.g. an RGB sensor in the case of three primaries. The results are presented in FIG. 4*a* which shows one example among others of a chromaticity distribution of a frame in a uniform color space, according to an embodiment of the present invention.

Figure 4A:
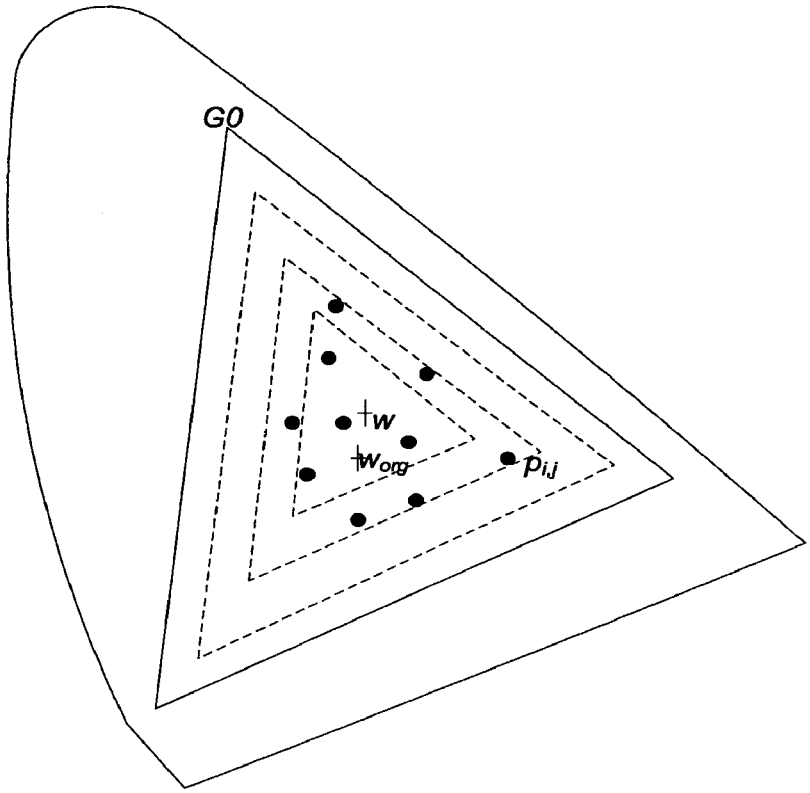
FIG. 4*a* is a diagram showing chromaticity distribution of a frame in a uniform color space (the xy space shown is not uniform and shown just for illustrative purposes), according to an embodiment of the present invention.

The outer triangle G0 in FIG. 4*a* shows the color gamut of the original light sources along with smaller triangles (shown with the dotted line) when primaries have been diluted (or desaturated as described below) uniformly, i.e., the color gamut has decreased but a white point remained the same. $W_{org}$ indicates the color coordinates of the white point for the uncorrected primary color light sources fully modulated. W indicates their white point after white-balancing (described above). This balancing is a consequence of the variations of emission peak wavelength and width of the light sources (e.g., LEDs) at various temperatures and number of operation hours, as light sources are provided by different suppliers. Pij (black dots) indicate the chromaticity of a pixel ij in the image. It is obtained by multiplying the primary digital values (e.g., RGB) with a color management profile matrix to transform the RGB values to a device-independent and uniform color space. This profile is either embedded in the image content itself or provided by each software application.

If the color gamut in the image of the frame is larger than the color gamut of the light sources of the display G0 (this situation is not shown in FIG. 4*a*), then the color gamut of the original image can be fitted (reduced) into the color gamut of the light sources of the display. In this case, no desaturation of the primaries will take place.

However, according to an embodiment of the present invention, if the color gamut in the image of the frame is smaller than the color gamut of the light sources of display G0, desaturation of the primaries will take place. A field duty factor (also alternatively called here a "desaturation factor") of the remaining colors diluting a primary is one minus the ratio of the distances between the white point and the chromaticities of the most saturated pixels in the frame and of the primary colors of the light sources. For example, in the case of a blue color, these distances are called dG0 and dG1 as shown in FIG. 4*b*.

Figure 4B:
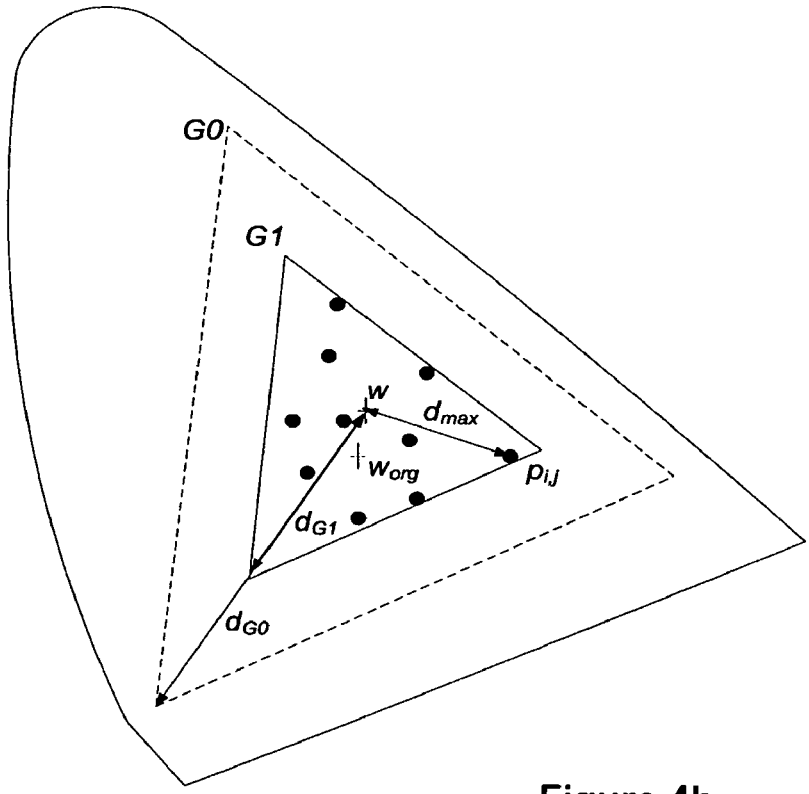
FIG. 4*b* is a diagram showing optimized gamut of a frame matching chromaticity distribution of the pixels in a uniform color space, according to an embodiment of the present invention.

FIG. 4*b* is an example among others of an optimized (e.g., decreased) gamut matching the chromaticity distribution of the frame pixels, according to an embodiment of the present invention. FIG. 4*b* shows the original gamut G0 as in FIG. 4*a* and the reduced gamut G1. The latter has been obtained by shrinking the gamut as much as possible while keeping the chromaticities of all pixels Pij. Thus, the desaturation factor (which can be also called a "duty ratio of the diluting colors"), defined above, will have a value between 0 and 1, where 1 means complete desaturation (black-and-white display) and 0 means no desaturation (full gamut).

It is noted that FIG. 4*b* shows the optimized gamut after uniform primary desaturation with unchanged white point W accomplished by linear scaling of the triangle in the uniform color space. But, according to an embodiment of the present invention, the same approach can be used in case of multi-primary displays with N>3.

Figure 2:
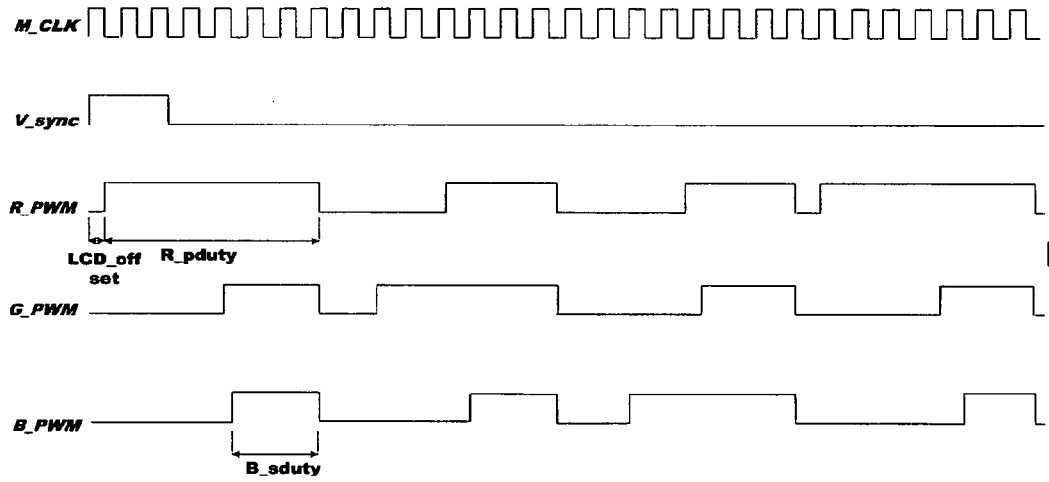
FIG. 2 is a timing diagram depicting synchronization signals and three primary (RGB) signals, wherein the non-primary colors in each field have been added with a duration of 50% of their duration in their primary field (i.e., with 50% desaturation), according to an embodiment of the present invention.

FIG. 2 further illustrates the desaturation discussed above by showing an example among others of a timing diagram depicting synchronization signals and three primary (RGB) signals, wherein the non-primary colors in each field have been added with a duration of 50% of their duration in their primary field (i.e., with 50% desaturation), according to an embodiment of the present invention;

Thus, the desaturation, according to an embodiment of the present invention, is executed by turning on the colors other than the primary in each field. The duration of each such non-primary color is determined by multiplying the desaturation ratio (0-100%) by the duration of the non-primary color in its primary field (the desaturation ratio is determined as described above). The luminance increases by the desaturation so an automatic, frame-per-frame compensation is carried out using the luminance control described below. This is necessary for avoiding flicker. Luminance increases linearly with the desaturation.

Luminance control (dimming) is carried out by multiplying the duration of each primary in each field by a factor zero to one, after having carried out the white point adjustment, desaturation, and flicker-eliminating luminance compensation described above. This can be done by either a user preference setting or a constant-contrast criterion determined by, e.g. the application or user preferences. The contrast, in turn, is determined by the reflectance of the device and illuminance as measured by an ambient light sensor. Since the luminance contrast is calculated by dividing the emitted luminance by the luminance of the ambient light reflected off the device surface or the luminance of the background light as measured by a forward-looking ambient light sensor, it is possible to determine the value of the emitted luminance to achieve the requested contrast. The value of the constant contrast can be determined by a display resolution, maximum spatial frequency content of the image, a viewing distance (set by the user or measured by, for example, the built-in camera), and an analytic contrast sensitivity function. The shape of the CSF (contrast sensitivity function) is different for moving images and may also be taken into account dynamically.

Thus, by using input from ambient light sensors, the necessary minimum luminance contrast can be achieved. The dynamic control of the overall display luminance by field duty (using, e.g., pulse-width modulation), according to an embodiment of the present invention, can include novel features of utilizing the image content to determine distribution of the spatial frequency and motion. This information together with a display resolution, a measured illuminance and a motion-dependent contrast sensitivity function (CSF) of the human eye determines the necessary contrast. The necessary contrast is then achieved by 1) calculating the luminance of the reflected light from the measured illuminance and the pre-measured device reflectance, and 2) tuning the display luminance so that the ratio of the display luminance and luminance of the reflected light (calculated in step 1) yields the necessary contrast value. Prior art has not taken into account the CSF, display resolution or content. One example among others of a summarized algorithm for achieving the adaptive luminance control (the algorithm can be applied both per frame or for an ensemble of frames) is presented below as follows:

1. Determine motion vector distribution by extracting motion vectors of MPEG content (unit: pixels/frame or pixels/sec);

2. Calculate the spatial frequency distribution by a fast Fourier transform (FFT);

3. Determine the expectation value of the minimum required contrast by multiplying the distributions obtained in steps (1) and (2) above with the analytical expression of the motion-dependent CSF; contrast sensitivity is the reciprocal of the Michelson contrast;

4. Measure the illuminance by the ambient light sensor;

5. Calculate the luminance of the reflected light from step (4) and from the pre-measured device reflectance;

6. Measure the illuminance from any bright background by using the ambient light sensor pointing at the direction opposite to the viewer;

7. Determine the luminance of the brightest spot in the field of view by taking the maximum of steps (5) and (6);

8. Tune the display luminance so that the lightness contrast ratio of the display becomes equal or larger than the contrast obtained in step (3) above. The lightness of the dark level is calculated from its CIE definition, results of step (7), and from s display luminance of the darkest level.

Figure 3:
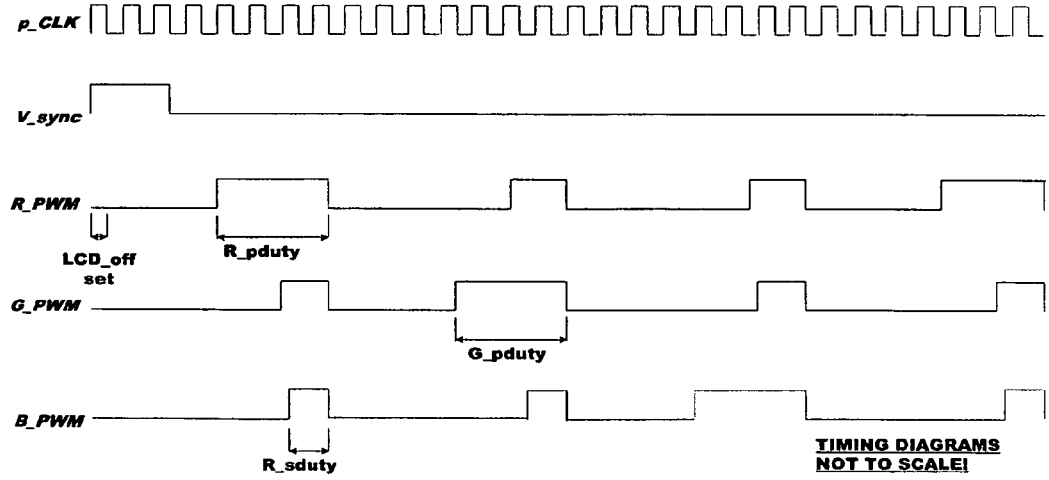
FIG. 3 is a timing diagram depicting synchronization signals and three primary (RGB) signals, wherein the non-primary colors in each field have been added with a duration of 50% of their duration in their primary field (i.e., with 50% desaturation) and wherein 50% luminance dimming is added by multiplying the durations of all colors in FIG. 2 by 0.5, according to an embodiment of the present invention.

FIG. 3 shows an example among others of a timing diagram depicting synchronization signals and three primary (RGB) signals, wherein the non-primary colors in each field have been added with a duration of 50% of their duration in their primary field (i.e., with 50% desaturation) and wherein 50% luminance dimming is added by multiplying the durations of all colors in FIG. 2 by 0.5, according to an embodiment of the present invention.

It is noted that in the case of motion video priority, the frame duties are deliberately made shorter to achieve sharper images. In order to preserve luminance, the colors then need to be desaturated. If the light sources are, e.g., LEDs, the average luminance can be also preserved by driving the LEDs at higher peak currents, though at a lower luminous efficiency. Depending on the user preferences, either luminous efficiency or color saturation can be given a preference.

Furthermore, if moving image quality is given a priority, the field duty can be assigned a predetermined value (e.g., using a user preference) or a dynamically determined value (e.g., using motion vector content), but generally a relatively small value (increased degree of an intermittent backlight). A smaller duty of the backlight gives better motion image quality but the effect is not so big below about 30%. A "relatively small value" could therefore be 30%-50% depending on the preference luminance/moving image quality. Doing so, however, will decrease the luminance, so the desaturation will have to increase by field duty decrease. The absolute duty is not necessarily the same because of the white balancing carried out first. The duties of all primaries are instead reduced proportionally (i.e., without a color shift) to achieve the higher video fidelity. The value of the field duty can be chosen by the user preference but could also be determined dynamically by actual motion content luminance requirements as determined by the ambient light sensor.

It is also noted that the eye is less sensitive to flicker at low luminances and the frame rate can, therefore, be lowered accordingly to save power. For a given frame rate, flicker can be reduced by displaying more than once the field which has higher luminance or by adding derived color field(s) to reduce the color difference between two consecutive fields, e.g. adding yellow between red and green. To do that, however, relative field duties can be adjusted according to embodiments of the present invention described herein, to compensate the white point shift that occurs.

Thus, according to embodiments of the present invention, the values of the fractions and total field duty can be determined using (but not be limited to) the following factors: the maximum color saturation of any pixel of the image to be displayed, the motion content of the image, the desired white point, the degree of potential flicker, the ambient light color and luminance, the desired luminance contrast, the color coordinates of the light sources (e.g., LEDs) themselves, etc.

Moreover, according to embodiments of the present invention, a light source (e.g., LED) power consumption can be dynamically minimized for each combination of ambient light and display contents. User preferences can be used to give priority to either the color reproduction or the moving image quality in determining the frame duty. The calculated primary color durations in each field can be converted into counts of either a pixel clock (low resolution) or an external clock (high resolution), and loaded dynamically into an LED (if the light source is an LED) controller. For each field, it simultaneously switches on each group of the primary LEDs, where the number of the LEDs per group is arbitrary. The counter can have a resolution high enough to enable the white point and the primary color coordinate adjustment within a maximum 0.02 CIE $\Delta u'v'$. The dimming range can be at least, but not limited to, 256 levels. A luminance increase by the dynamic desaturation of the primaries, according to embodiments of the present invention, saves power and cost because it can be done without reduction of the luminous efficiency. Hence, fewer light sources (e.g., LEDs) are needed and/or smaller duties are sufficient. The LEDs can also be driven at lower average currents, resulting in longer life times. LEDs with larger manufacturing spread in luminous intensity can be used hence saving backlight costs. A higher color saturation is possible at lower illuminances. Blur-free video, and reduction of a color breakup can be achieved without increasing the frame rate, therefore saving driving power. White point adjustment can be done over the entire gamut without loss in the bit depth and while maintaining the luminous efficiency.

By operating the LEDs at a constant and optimum current and controlling the luminance and color by pulse-width modulation (PWM), the maximum luminous efficiency is achieved for any luminance. With the dynamic RGB sensor option, the white point is ensured even after LED aging or at temperatures other than a room temperature.

Figure 5:
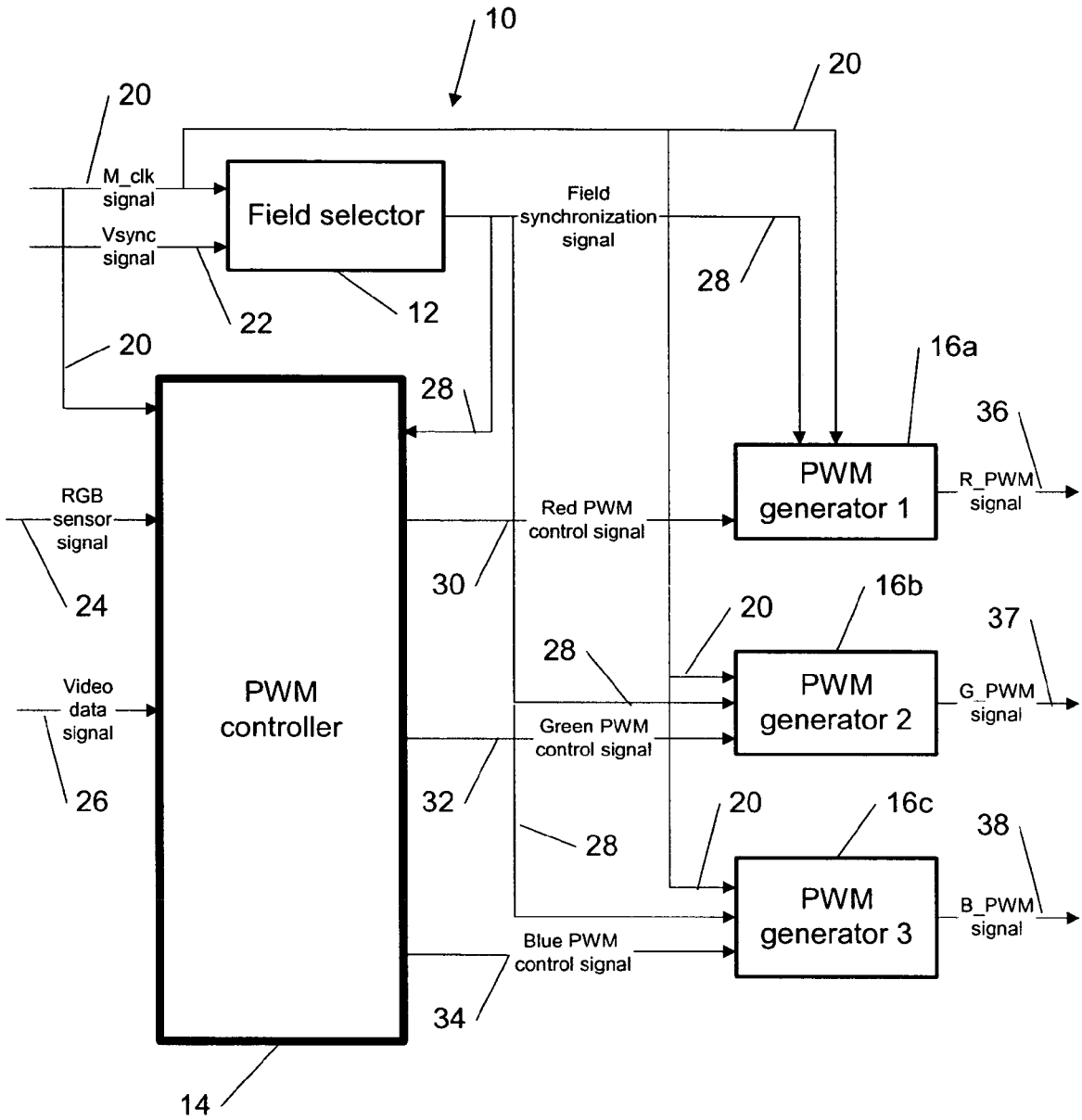
FIG. 5 is a block diagram of a pulse width modulation scheme in an electronic device comprising a display demonstrating an implementation of a dynamic color gamut adjustment for three RGB primaries (red, green, blue), according to an embodiment of the present invention.

FIG. 5 shows an example among others of a block diagram of a pulse width modulation scheme in an electronic device 10 comprising a display demonstrating an implementation of a dynamic color adjustment for three RGB primaries (red, green, blue), according to an embodiment of the present invention.

The electronic device 10 comprises a field selector 12, for defining N color fields for K primary colors, wherein $K \geqq 3$ and $N \geqq K$. Vsync signal 22 is the vertical sync from the video signal input, and a field synchronization signal 28 is the vertical sync for each color field which defines the N color fields for the K primary colors, and M_clk signal 20 is a clock signal.

The electronic device 10 also comprises a PWM controller 14, which can be used for setting the field duties of the N primary colors in the K color fields using the predefined white-balancing procedure (as described above), for further determining for each color field of the K color fields further field duties of colors of the N−1 primary colors not included in each color field using a predetermined criterion to dynamically control each of the N primary colors (also as described above), such that said colors with the further field duties can be used in said color fields for dynamically adjusting the color gamut of the display. Further, the PWM controller 14 can comprise means for determining a coefficient between zero and one using a further predetermined criterion and multiplying the field duties and the further field duties by said coefficient for dynamically adjusting the luminance of the display. Generally, the means for determining the coefficient between zero and one can be a separate block from the PWM controller.

The block 14 is responsive to an RGB sensor signal 24 (e.g., the RGB sensor can be combined with the ambient light sensor), responsive to a video data signal 26 and to the field synchronization signal 28, and provides a Red PWM control signal 30, a Green PWM control signal 32 and a Blue PWM control signal 34 to PWM (pulse width modulation) generators 16*a*, 16*b*, and 16*c*, respectively. Using these input signals 32, 33 and 34 (as well standard input signals 28 and 20), the blocks 16*a*, 16*b*, and 16*c* provide modulation signals, a R_PWM signal 36, a G_PWM signal 37 and a B_PWM signal 38, respectively, to the appropriate light sources of the display in the electronic device 10.

Figure 6:
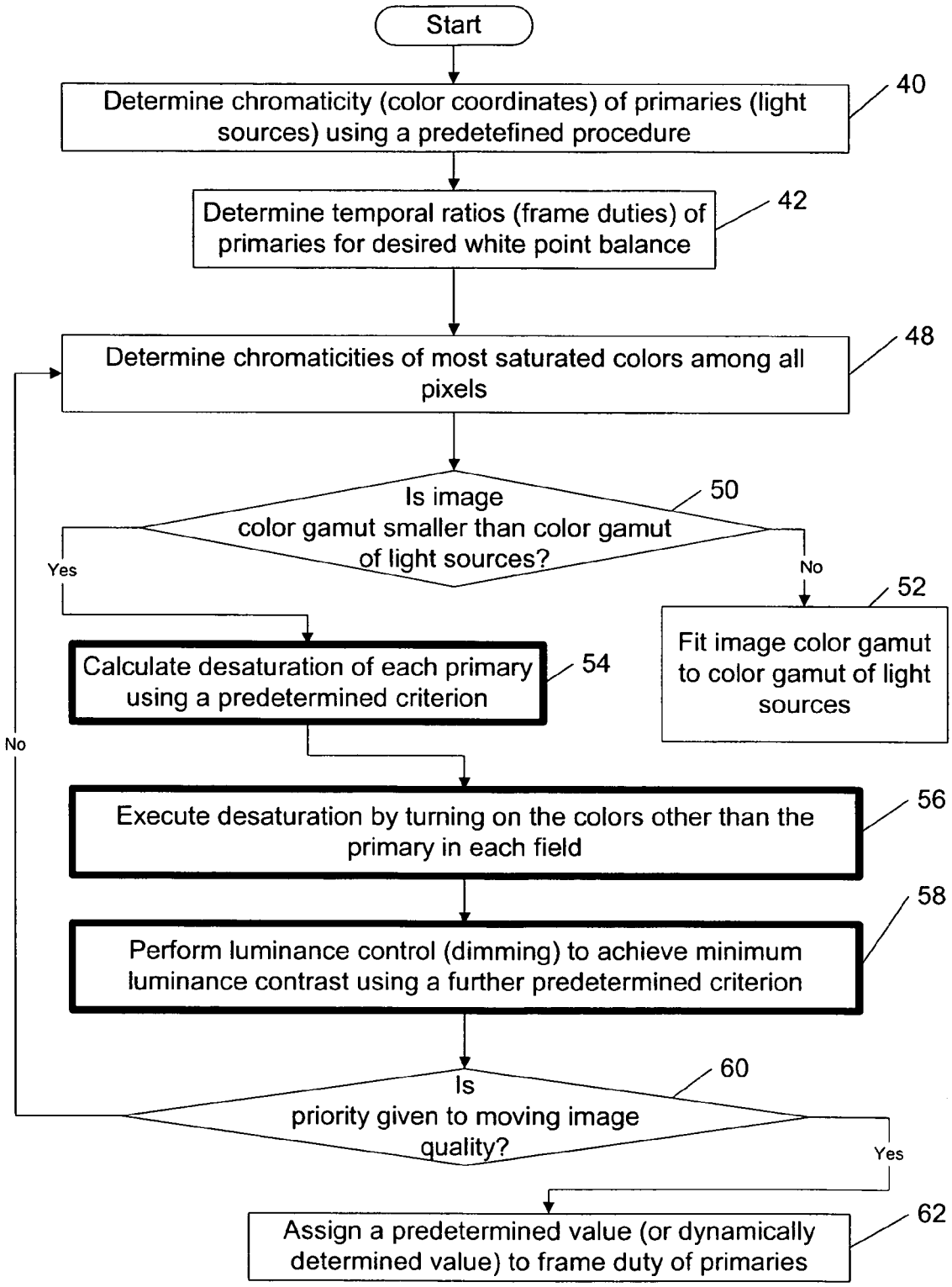
FIG. 6 is a flow chart illustrating a pulse width modulation implementation of a dynamic color gamut adjustment for three RGB primaries (red, green, blue) in an electronic device comprising a display, according to an embodiment of the present invention.

FIG. 6 is a flow chart illustrating a pulse width modulation implementation of a dynamic color adjustment for three RGB primaries (red, green, blue) in the electronic device 10 comprising a display, according to an embodiment of the present invention.

The flow chart of FIG. 6 only represents one possible scenario among others. Detailed description of the steps depicted in FIG. 6 is described above. In a method according to the first embodiment of the present invention, in a first step 40, chromaticity of the primaries (i.e., the light sources) is determined using a predefined procedure (as described above) and stored in the memory of the electronic device 10. In a next step 42, the temporal ratios (duties) of the primaries for the desired white point balance are determined.

In a next step 48, the chromaticities of the most saturated colors among all pixels are determined. In a next step 50, it is ascertain whether the image color gamut of the frame is smaller than the color gamut of the light sources. If that is not the case, in next a step 54, the image color gamut of the frame is fitted to the color gamut of the light sources. If, however, it is ascertained that the image color gamut of the frame is smaller than the color gamut of the light sources, in a next step 52, the desaturation of each primary is calculated using a predetermined criterion (as described above). In a next step 56, the desaturation is implemented by turning on the colors other than the primary in each field. In a next step 58, the luminance control (dimming) for achieving the minimum luminance contrast is performed using a further predetermined criterion (as described above).

In a next step 60, it is ascertain whether the priority is given to the moving image quality. If that is not the case, the process goes back to step 48. However, if it is ascertained that the priority is given to the moving image quality, in a next step 62, the predetermined value or the dynamically determined value is assigned to the frame duty of the primaries. As discussed above, if the priority is given to the moving image quality, the field duty can be shortened, e.g., to a predetermined value (30-50%). Furthermore, to keep the contrast, the luminance can be adjusted, if necessary, by further desaturation (steps 48-58).

It is noted that, according to embodiments of the present invention, the number of primaries can be 3 or more ($N \geqq 3$). and not only limited to the traditional RGB case.

As explained above, the invention provides both a method and corresponding equipment consisting of various modules providing the functionality for performing the steps of the method. The modules may be implemented as hardware, or may be implemented as software or firmware for execution by a computer processor. In particular, in the case of firmware or software, the invention can be provided as a computer program product including a computer readable storage structure embodying computer program code (i.e., the software or firmware) thereon for execution by the computer processor.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A method for dynamically adjusting a display in an electronic device, comprising the steps of:

determining field duties of N primary colors in K color fields using a predefined procedure, wherein $N \geqq 3$ and $K \geqq N$; and determining for each color field of said K color fields further field duties of colors of said N−1 primary colors not included in said each color field using a predetermined criterion to dynamically control each of said N primary colors, such that said colors with said further field duties can be used in said color fields for dynamically adjusting a color gamut of said display.

2. The method of claim 1, further comprising the step of:

turning on said colors with said further field duties in said each color field.

3. The method of claim 1, wherein said display is a field sequential color display.

4. The method of 1, wherein said display is at least one of: a liquid crystal display (LCD), a micro-electro-mechanical systems (MEMS) display, a direct-view display, a near-eye display or a projection display.

5. The method of claim 1, wherein said primary colors are red, green and blue.

6. The method of claim 1, wherein before the step of determining the field duties of the N primary colors, the method comprises the step of:

determining color coordinates of the primary colors of light sources such that these color coordinates can be used for said determining of said further field duties.

7. The method of claim 1, wherein, if a moving image quality is given a priority, the field duties of the N primary colors are assigned a predetermined value.

8. The method of claim 1, wherein the field duties of the N primary colors are determined using a desired white point.

9. The method of claim 1, wherein said further field duties are fractions of said field duties in said each color field.

10. The method of claim 1, further comprising the steps of:

determining a coefficient between zero and one using a further predetermined criterion; and multiplying said field duties and said further field duties by said coefficient for dynamically adjusting a luminance of said display.

11. The method of claim 1, wherein said colors with said further field duties can be used in said color fields for dynamically adjusting a luminance of said display.

12. A computer program product comprising: a computer readable storage structure embodying computer program code thereon for execution by a computer processor with said computer program code characterized in that it includes instructions for performing the steps of the method of claim 1 indicated as being performed by any component or a combination of components of the electronic device.

13. The computer program product of claim 12, further comprising the steps of:

determining a coefficient between zero and one using a further predetermined criterion; and multiplying said field duties and said further field duties by said coefficient for dynamically adjusting a luminance of said display.

14. An electronic device with a display, comprising:

a field selector, for defining K color fields for N primary colors, wherein $N \geqq 3$ and $K \geqq N$; and a PWM controller, for determining field duties of said N primary colors in the K color fields using a predefined procedure, for further determining for each color field of said K color fields further field duties of colors of said N primary colors not included in said each color field using a predetermined criterion to dynamically control each of said N primary colors, such that said colors with said further field duties can be used in said color fields for dynamically adjusting a color gamut of said display.

15. The electronic device of claim 14, further comprising:

means for turning on said colors with said further field duties in said each color field.

16. The electronic device of claim 14, wherein said display is a field sequential color display.

17. The electronic device of 14, wherein said display is at least one of: a liquid crystal display (LCD), a micro-electro-mechanical systems (MEMS) display, a direct-view display, a near-eye display or a projection display.

18. The electronic device of claim 14, wherein, if a moving image quality is given a priority, the field duties of the N primary colors are assigned a predetermined value.

19. The electronic device of claim 14, wherein the field duties of the N primary colors are determined using a desired white point balance.

20. The electronic device of claim 14, wherein said further field duties are fractions of said field duties in said each color field.

21. The electronic device of claim 14, further comprising:

means for determining a coefficient between zero and one using a further predetermined criterion and multiplying said field duties and said further field duties by said coefficient for dynamically adjusting a luminance of said display.

22. The electronic device of claim 14, wherein said means for determining the coefficient between zero and one is a part of the PWM controller.

23. The electronic device of claim 14, wherein said electronic device is a non-portable electronic device, a television, a computer, a monitor, a wireless communication device, a mobile phone, a camera-phone mobile device or a portable electronic device.

24. The electronic device of claim 14, wherein said colors with said further field duties can be used in said color fields for dynamically adjusting a luminance of said display.

* * * * *